US007513502B1

(12) United States Patent
Nygren et al.

(10) Patent No.: US 7,513,502 B1
(45) Date of Patent: Apr. 7, 2009

(54) STOREY TELLING GAME

(76) Inventors: Violet E. Nygren, P.O. Box 10, Creston, BC (CA) V0B 1G0; Debby L. Kison, P.O. Box 10, Creston, BC (CA) V0B 1G0

( * ) Notice: Subject to any disclaimer, the term of this patent is extended or adjusted under 35 U.S.C. 154(b) by 27 days.

(21) Appl. No.: 11/688,229

(22) Filed: Mar. 19, 2007

(51) Int. Cl.
*A63F 3/00* (2006.01)

(52) U.S. Cl. ..... 273/243; 273/138.1

(58) Field of Classification Search ..... 273/138.1, 273/139, 142 R, 142 H, 142 HA, 142 J, 142 JA, 273/142 A, 142 D, 243, 259, 277
See application file for complete search history.

(56) References Cited

U.S. PATENT DOCUMENTS

| | | | | |
|---|---|---|---|---|
| 3,940,863 | A | 3/1976 | Kritzberg | |
| 4,684,135 | A | 8/1987 | Bouchal | |
| 5,002,282 | A | 3/1991 | Hanley | |
| 5,435,726 | A | 7/1995 | Taylor | |
| 5,746,433 | A | 5/1998 | Klassen | |
| D410,501 | S | 6/1999 | Langford | |
| 6,019,372 | A * | 2/2000 | Polaski et al. | 273/272 |
| 6,217,022 | B1 * | 4/2001 | Astaneha | 273/138.1 |
| 6,536,766 | B1 * | 3/2003 | Deitch et al. | 273/287 |

* cited by examiner

*Primary Examiner*—Vishu K. Mendiratta

(57) ABSTRACT

A story telling game having a spinner wheel divided into sections imprinted with instructions such as "SERVE GUESTS", "GIVE A CARD", "REST AND RELAX", "TAKE A CARD", SPIN OFF", and "STORY and a number, cards imprinted with topics such as "cooking disaster", "fender bender" or "got caught", and a timer. The first player to discard his topic cards wins. A player discards a topic card by landing on "STORY", telling a story related to his topic card, and stating "That's my story and I'm sticking to it" within 300 seconds. "GIVE A CARD" and "TAKE A CARD" requires a player to give or take a topic card to or from another player, respectively. "SPIN OFF" requires each player to spin and the players spinning the highest and lowest numbers to trade topic cards. "SERVE GUESTS" requires a player to serve snacks and drinks to other players within 300 seconds.

1 Claim, 2 Drawing Sheets

STOREY TELLING GAME

BACKGROUND OF THE INVENTION

Various types of games are known in the prior art. Prior art patents disclose games designed to improve communication skills of players.

U.S. Pat. No. 4,684,135 issued to Bouchal on 1987 Aug. 4 teaches a board game which uses cards and involves story-telling. Each game player is provided with a game card imprinted with pictorial illustrations and legends characterizing a predetermined number of different kinds of stories which each player is to tell during the course of play. Each player in turn randomly selects the primary characteristics of a story to be told. The player then randomly selects a randomly predetermined number of graphic images, these being then used by such player to tell a story of the previously selected character. Upon the successful completion of telling a story, such player is given a frame to place about the particular pictorial illustration bearing the characterizing legend for the story just told. The game is completed when a player has first provided frames about all the pictorial illustrations of his game card.

U.S. Pat. No. 5,435,726 issued to Taylor on 1995 Jul. 25 teaches an amusement game in which players tell stories focused on native American Indian culture. Each player is given story stones with each story stone being imprinted with a native American Indian hieroglyphic symbol and legend characterizing a different subject of the story being told, whether it be a true story of history or a randomly made up story. Upon the successful completion of telling a story, the player ties one know in a jute rope.

U.S. Pat. No. 3,940,863 issued to Kritzberg on 1976 Mar. 2 provides a psychological testing and therapeutic game device in which players tell stories based on iconographic stimuli, each tending to invoke a significant primary emotion. Dice and cards are used to play the game and both intermediate awards and concrete rewards provide incentive for storytelling and fantasizing.

U.S. Pat. No. 5,746,433 issued to Klassen et al. on 1998 May 5 provides a method of playing a game in which players tell stories to develop public speaking abilities. A single die is cast to determine the order of play. In addition, timing and grammar judges are selected. Each player speaks about a topic determined by drawing a card and then casting a die to determine which topic on the card will be used. A player receives 1 point for every second of speech with a maximum of 3 minutes allowed and 180 points. Points are deducted for speech fillers and pauses. Ten points are lost for straying from the player's topic.

U.S. Pat. No. 5,002,282 issued to Hanley on 1991 Mar. 26 teaches a method of playing a game in which players verbally describe relationships between randomly chosen concepts.

U.S. Design Pat. No. 410,501 issued to Langford on 1999 Jun. 1 illustrates an ornamental design for a game board.

The primary objects of the present story telling game are to entertain and educate players, while improving communication skills and encouraging socialization among players. The present game provides a spinner wheel, a variety of topic cards, and a timer. The round spinner wheel has a tab against which flexible stops located at the intersection between play sections come to rest after a player has spun the spinner wheel. The spinner wheel is divided into spaces, which are imprinted with instructions for game play, including such as "SERVE GUESTS", "GIVE A CARD", "REST AND RELAX", "TAKE A CARD", SPIN OFF", and "STORY". The topic cards are imprinted on one side with the title of the game and on the other side with a variety of topics such as "cooking disaster", "fender bender" or "got caught". The timer has an on-off switch, a set button to allow a player to set the timer for 0 to 300 seconds and a re-set button. At the beginning of each game, each player is dealt five topic cards. The object of the game is to be the first player to discard all of his or her topic cards. A player may discard one of his or her topic cards upon landing upon the "STORY" play spaces on the spinner wheel, telling a story related to the topic of the player's topic card and stating "That's my story and I'm sticking to it" within 300 seconds. A story may be about the player himself, someone the player knows, or about something the player has heard about. Players also follow the instructions provided on the remaining spaces of the spinner wheel as part of the game.

FIELD OF THE INVENTION

The present invention relates to games, and more particularly, to a story telling game which is designed to provide an amusing and informative board game to encourage players to become more acquainted with one another, while promoting good manners and improving communication skills.

SUMMARY OF THE INVENTION

In view of the aforestated known types of story telling games now present in the prior art, the general purpose of the present story telling game, described subsequently in greater detail, is to provide a story telling game which has many novel features that result in a story telling game which is not anticipated, rendered obvious, suggested, or even implied by prior art, either along or in combination thereof.

To accomplish this, the present story telling game comprises a spinner wheel, a variety of topic cards, and a timer. The round spinner wheel has a tab against which flexible stops located at the intersection between play sections come to rest after a player has spun the spinner wheel. The spinner wheel is divided into pie-shaped spaces, which are imprinted with instructions for game play, including such as "SERVE GUESTS", "GIVE A CARD", "REST AND RELAX", "TAKE A CARD", SPIN OFF", and "STORY", as well as with a nonduplicative number from 1 to 16. The topic cards are imprinted on one side with the title of the game and on the other side with a variety of topics such as "cooking disaster", "fender bender" or "got caught". The timer has an on-off switch, a set button to allow a player to set the timer for 0 to 300 seconds and a re-set button. At the beginning of each game, each player is dealt five topic cards. The object of the game is to be the first player to discard all of his or her topic cards. A player may discard one of his or her topic cards upon landing upon the "STORY" play spaces on the spinner wheel, telling a story related to the topic on the player's topic card and stating "That's my story and I'm sticking to it" within 300 seconds. A story may be about the player himself, about someone the player knows, about something the player has heard about or about something the player creates or imagines. The stories may be true or false. The stories encourage laughter and fun. If a player spins and the spinner wheel stops on a space imprinted with "GIVE A CARD", the player gives one of his undiscarded topic cards to any other player. If a player spins and the spinner wheel stops on a space imprinted with "TAKE A CARD", the player may take any other player's undiscarded topic card. If the spinner wheel stops on a space imprinted with "SPIN OFF", each player spins the spinner wheel. Then, the player spinning the highest number and the lowest number trade undiscarded cards. If a player's spin stops on a space imprinted with "SERVE GUESTS", the player must serve snacks and drinks to as many other players as the player is able to serve within 300 seconds.

The instant story telling game may be played an unlimited number of times by multiple players and players of a variety of ages. The present game is suitable for play by small to large groups. The lightweight and portable story telling game can be easily transported to and played at almost any location. The limited number of parts simplifies storage of the present story telling game. The story telling game is compact for storage in limited space. The present story telling game is made of typical materials known in the art.

An alternative embodiment may further comprise topic cards imprinted with x-rated topics. Another alternative embodiment may comprise topic cards imprinted with juvenile topics.

An object of the present story telling game is to create an environment that encourages players to become more acquainted with one another.

Another object of the present story telling game is to promote good manners.

Yet another object of the present game is to improve players' communication skills.

Still another object of the present story telling game is to provide a game which may be played by small to large groups.

Even still another object of the present story telling game is to provide a game which may be played by players of wide range of ages.

Even yet another object of the present game is to provide a story telling game which may be played in a wide variety of settings.

It is yet a further object of the present story telling game to provide a game, the rules for which are easy to learn.

It is yet even a further object of the present story telling game to provide a game which is portable and compact for storage in small storage spaces.

Thus has been broadly outlined the more important features of the present story telling game and method so that the detailed description thereof that follows may be better understood and in order that the present contribution to the art may be better appreciated.

Numerous objects, features and advantages of the present story telling game will be readily apparent to those of ordinary skill in the art upon reading the following detailed description of presently preferred, but nonetheless illustrative, examples of the present story telling game and method when taken in conjunction with the accompanying drawings. In this respect, before explaining the current examples of the present story telling game and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the story telling game and method. It is therefore important that the claims be regarded as including such equivalent constructions insofar as they do not depart from the spirit and scope of the present invention.

Objects of the present story telling game and method, along with various novel features that characterize the invention are particularly pointed out in the claims forming a part of this disclosure. For better understanding of the story telling game and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
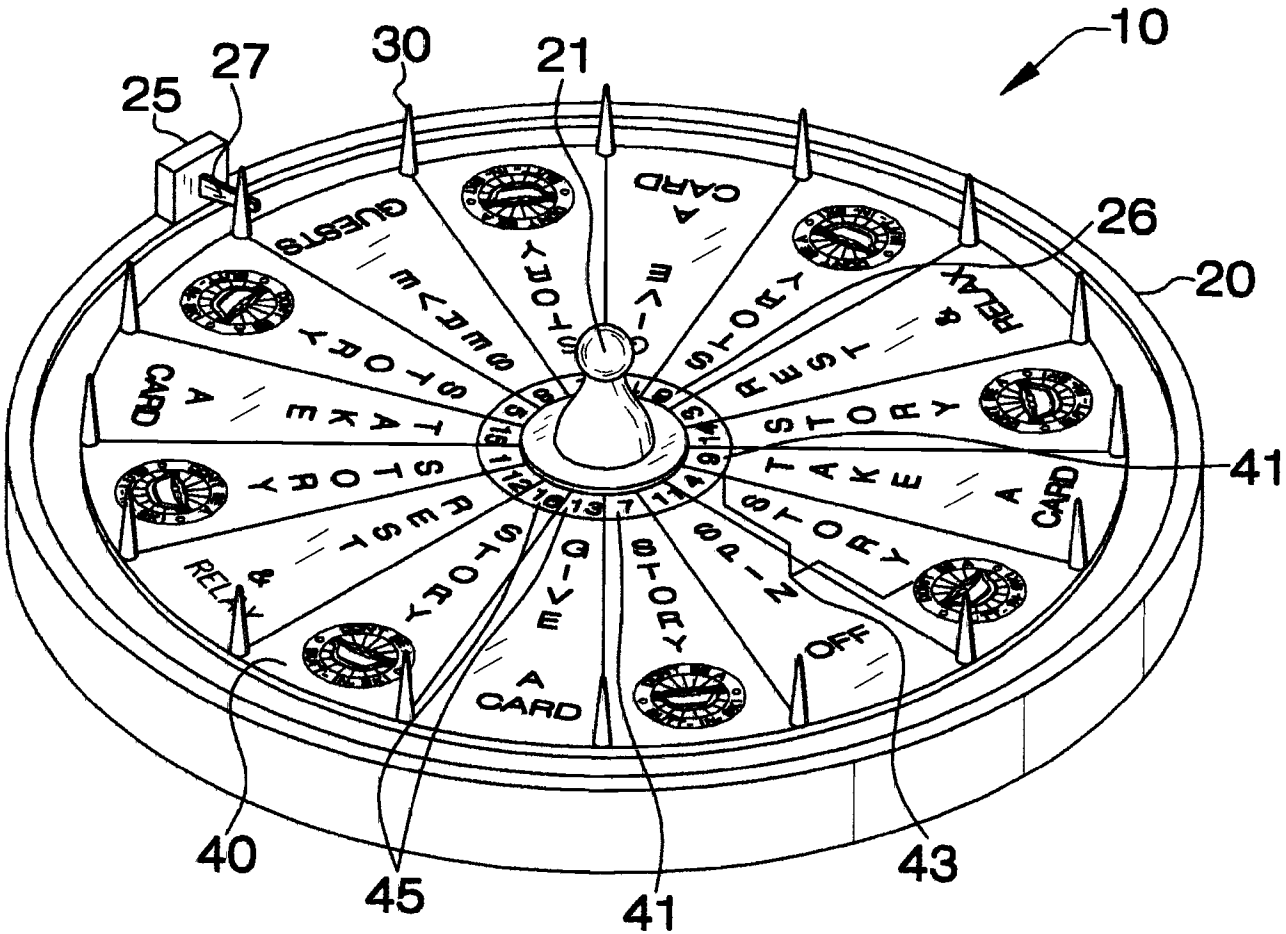
FIG. 1 is an isometric view of a spinner wheel which is a component of the present story telling game.
Figure 2:
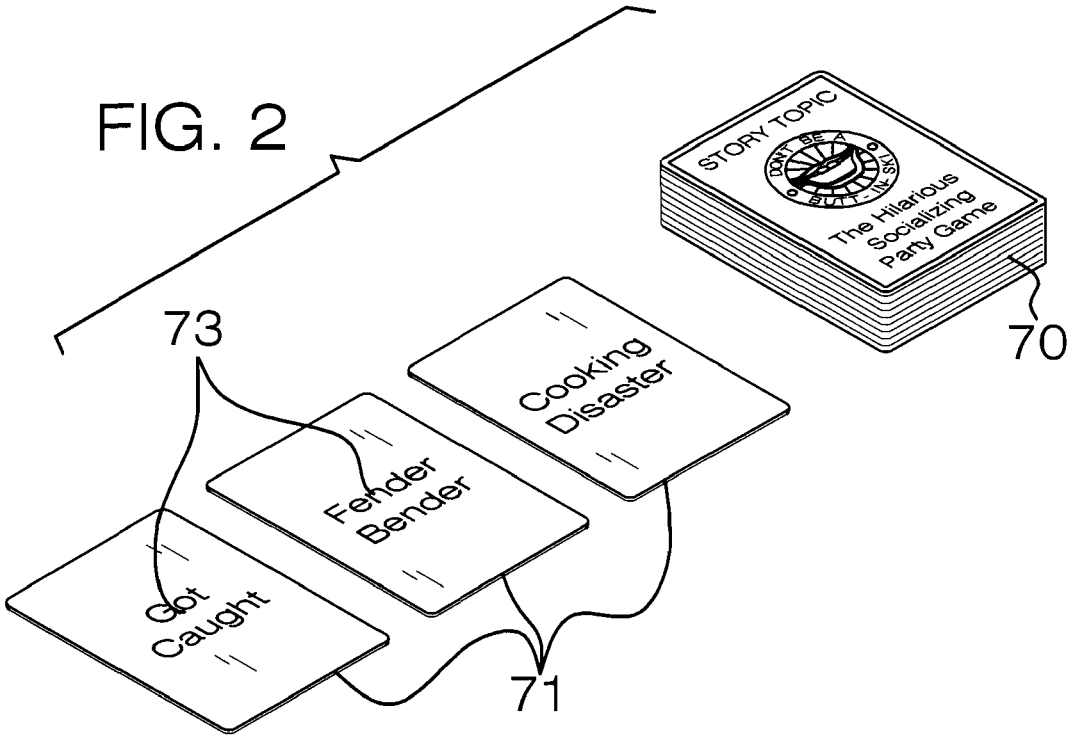
FIG. 2 is a perspective view of cards which are a component of the present game.
Figure 3:
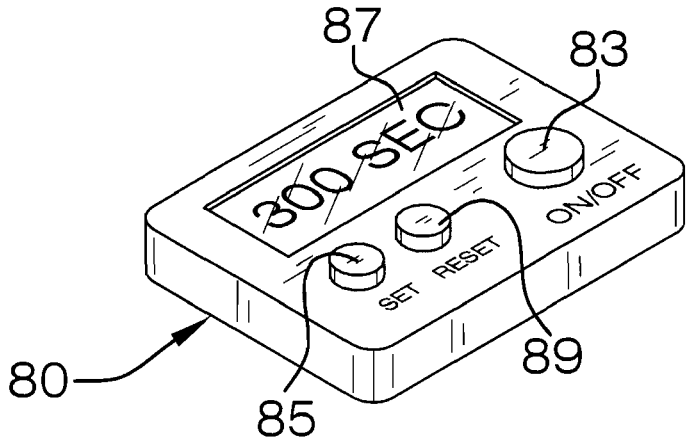
FIG. 3 is an isometric view of a timer which is a component of the present game.

With reference now to the drawings, and in particular FIGS. 1 through 3 thereof, example of the instant story telling game employing the principles and concepts of the present story telling game and generally designated by the reference number 10 will be described.

Referring to FIGS. 1 through 3, the present story telling game 10 comprises a spinner wheel 20, a deck of topic cards 70, and a timer 80. The spinner wheel 20 is disk-shaped, resembling a conventional spinner wheel. Said spinner wheel 20 comprises a spin knob 21, a conventional spinner wheel parallelpiped tab base 25 having a semi-flexible tab 27, a plurality of pie-shaped sections 40, and a small concentric circle 26 surrounding said spin knob 2. Said circle 26 is divided into pie-shaped units 41 corresponding to said sections 40, each of said units 41 is imprinted with a nonduplicative number 45, preferably ranging from 1 to 16. Said tab 27 provides friction against which flexible stops 30 located at the intersection between said sections 40 come to rest after a player has spun the spinner wheel 20. Said sections 40 are imprinted with various instructions 43 for game play. Said instructions 43 consists of: "SERVE GUESTS", "GIVE A CARD", "REST & RELAX", "TAKE A CARD", SPIN OFF", and "STORY". Each topic card 71 within the top card deck is imprinted on one side with the words "Don't Be a Butt-In-Ski" and on the other side with a variety of topics 43 for relating stories such as "cooking disaster", "fender bender" or "got caught". The timer 80 comprises an on-off switch 83, a set button 85 to allow a player to set the timer for a maximum of 300 seconds, a LCD display 87 for displaying the amount of time remaining in which a player is given to tell a story, and a re-set button 89 to reset said timer 80 back to 0 seconds.

Use

The object of the game is to be the first player to discard all of his or her topic cards 71. To initiate game play, each player spins the spinner wheel 20 to determine the order of play. A player who spins the highest number 45, as determined by the number 45 upon the tab 27 lands during the player's spin, starts game play first. The player who spins the lowest number 45 deals a plurality of topic cards 71, preferably five, from the topic card deck 70 to each of the players each player is dealt a plurality of topic cards 71. The player who starts game play first spins the spinner wheel 20 first and follows the instruction 43 imprinted on a section 40 of the spinning wheel 20 upon which the tab 27 stops. If a player spins and said tab stops on a section 40 imprinted with "STORY", said timer 80 is set to count down 300 seconds by pressing said set button 85. A player may discard one of his or her topic cards 71 into a discarded stack upon landing upon the section 40 of the spinner wheel 20 imprinted with the word "STORY" by telling a story related to the story topic 73 on the player's topic card 71 and stating "That's my story and I'm sticking to it" within 300 seconds. A story may be about the player himself, about someone the player knows, about something the player has heard about or about something the player relates or imagines. The stories may be true or false. The stories encourage laughter and fun. If a player spins and the spinner wheel 20 stops on a section 40 imprinted with an instruction 43 to "GIVE A CARD", the player gives one of his undiscarded topic cards 71 to any other player. If a player spins and the spinner wheel 20 tab 27 stops on a section 40 imprinted with an instruction 43 to "TAKE A CARD", the player may take any other player's undiscarded topic card 71. If the spinner wheel 20 stops on a section 40 imprinted with an instruction 43 to "SPIN OFF", each player spins the spinner wheel 20 at which point, the player spinning the highest number 45 on the spinner wheel 20 and player spinning the lowest number 45 trade undiscarded topic cards 71. If a player's spin stops on a section 40 imprinted with an instruction 43 to "SERVE GUESTS", the player must serve snacks and drinks to as many other players as the player is able to serve within 300 seconds.

The instant story telling game 10 may be played an unlimited number of times by multiple players and players of a variety of ages. The present game 10 is suitable for play by small to large groups of players. The lightweight and portable story telling game 10 can be easily transported to and played at almost any location. The limited number of parts simplifies storage of the present story telling game 10. The story telling game 10 is compact for storage in limited space. The present story telling game 10 is made of typical materials known in the art.

With respect to the above description then, it is to be realized that the optimum dimensional relationships for the parts of the present story telling game to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a story telling game comprising the steps of:

initiating game play by each player spinning a spinning wheel to determine the order of play, said spinning wheel having a flexible tab to stop on one of a plurality of sections displaying instructions and also displaying a range of numbers starting said order of play by a player who spins the highest number;

dealing to each player a plurality of topic cards from a deck of topic cards, each of said topic cards being imprinted with a story topic;

discarding a topic card into a discarded stack upon landing upon a section of said spinner wheel imprinted with the word "STORY, upon drawing a topic card, upon telling a story related to said story topic imprinted, and upon stating "That's my story and I'm sticking to it" within 300 seconds as measured on a timer for maintaining time;

spinning of said spinner wheel by a player to stop said tab on a section imprinted with an instruction to "GIVE A CARD", thus requiring said player to give one of said player's topic cards to another player;

spinning of said spinner wheel by a player to stop said tab on a section imprinted with an instruction to "TAKE A CARD", thus requiring said player to take another player's topic card;

spinning of said spinning wheel by a player to stop said tab on a section imprinted with an instruction to "SPIN OFF", thus requiring each player to spin the spinner wheel at which point, a player spinning the highest number on said spinner wheel and a player spinning the lowest number trade topic cards;

spinning of said spinning wheel by a player to stop said tab on a section imprinted with an instruction to "SERVE GUESTS" requiring said player to serve snacks and drinks to as many other players as said player is able to serve within 300 seconds as measured on said timer; and discarding all of a player's topic cards and, thus, being declared the winner of said story telling game.

* * * * *